US009719646B2

(12) United States Patent
Fedosik et al.

(10) Patent No.: US 9,719,646 B2
(45) Date of Patent: Aug. 1, 2017

(54) HEADLAMP FOR VEHICLES

(71) Applicant: Hella KGaA Hueck & Co., Lippstadt (DE)

(72) Inventors: Dmitry Fedosik, Lippstadt (DE); Bernd Giepen, Erwitte (DE); Matthias Knoche, Bad Westernkotten (DE); Ronny Letzin, Lippstadt (DE); Ralf Spiekermann, Lippstadt (DE)

(73) Assignee: Hella KGaA Hueck & Co., Lippstadt (DE)

( * ) Notice: Subject to any disclaimer, the term of this patent is extended or adjusted under 35 U.S.C. 154(b) by 12 days.

(21) Appl. No.: 14/906,780

(22) PCT Filed: Jul. 24, 2014

(86) PCT No.: PCT/EP2014/065904
§ 371 (c)(1),
(2) Date: Jan. 21, 2016

(87) PCT Pub. No.: WO2015/014706
PCT Pub. Date: Feb. 5, 2015

(65) Prior Publication Data

US 2016/0169467 A1 Jun. 16, 2016

(30) Foreign Application Priority Data

Aug. 2, 2013 (DE) ..... 10 2013 108 343

(51) Int. Cl.
*F21V 9/00* (2015.01)
*F21S 8/10* (2006.01)

(52) U.S. Cl.
CPC ..... *F21S 48/1241* (2013.01); *F21S 48/115* (2013.01); *F21S 48/1154* (2013.01);
(Continued)

(58) Field of Classification Search
CPC .. F21S 48/1231; F21S 48/115; F21S 48/1154; F21S 48/1159; F21S 48/1394; F21S 48/145
(Continued)

(56) References Cited

U.S. PATENT DOCUMENTS 8,801,250 B2 * 8/2014 Uchida ..... F21S 48/1382 362/351
2008/0239744 A1 * 10/2008 Nakada ..... B60Q 1/0041 362/516
(Continued)

FOREIGN PATENT DOCUMENTS

DE 102010041096 A1 3/2012
DE 102011013211 A1 9/2012
WO 2012034936 A1 3/2012

*Primary Examiner* — Bryon T Gyllstrom
(74) *Attorney, Agent, or Firm* — Husch Blackwell LLP

(57) ABSTRACT

A headlamp for vehicles having a projection module containing a first light source for generating a first light bundle, a reflector assigned to the first light source, a lens, and an edge disposed in a focal plane for generating a low beam light distribution. The headlamp also includes a second light source for generating a second light bundle and an optics unit disposed between the lens and the second light source for generating a supplementary light distribution, such that by superimposing the supplementary light distribution and the low beam light distribution, a high beam light distribution is formed. The optics unit is formed by a flat waveguide having a light entry surface for receiving the second light bundle emitted from the second light source. The second light source is disposed in the proximity of the light entry surface, having a light exit surface, and flat sides extending between the light entry surface and the light exit surface, on which entering light can be conducted through total reflection. A light/dark border of the low beam light distribution is formed by the edge of the flat waveguide formed as the
(Continued)

front outer edge, which connects the light exit surface and an upper flat side of the waveguide. The upper flat side of the flat waveguide is provided with a light blocking coating, such that an entry of light beams from the first light bundle striking the upper flat side is prevented.

10 Claims, 2 Drawing Sheets

(52) U.S. Cl.
CPC ..... *F21S 48/1159* (2013.01); *F21S 48/1394* (2013.01); *F21S 48/145* (2013.01)

(58) Field of Classification Search
USPC ..... 362/511
See application file for complete search history.

(56) References Cited

U.S. PATENT DOCUMENTS

2009/0190323 A1* 7/2009 Watanabe ..... B60Q 1/143 362/37
2010/0020563 A1* 1/2010 Ito ..... F21S 48/1154 362/547
2010/0033984 A1* 2/2010 Sugimoto ..... B60Q 1/143 362/538
2010/0246204 A1* 9/2010 Inaba ..... F21S 48/1159 362/539
2011/0149586 A1* 6/2011 Schug ..... F21S 48/1159 362/519
2015/0277027 A1* 10/2015 Koizumi ..... F21S 48/215 362/511

* cited by examiner

HEADLAMP FOR VEHICLES

CROSS REFERENCE

This application claims priority to PCT Patent Application No. PCT/EP2014/065904, filed Jul. 14, 2014, which itself claims priority to German Application No. 10 2013 108343.9, filed Aug. 2, 2013, the entirety of both of which are hereby incorporated by reference.

FIELD OF THE INVENTION

The invention relates to a headlamp for vehicles having a projection module containing

- a first light source for generating a first light bundle, a reflector assigned to the first light source, a lens and an edge disposed in a focal plane of the lens for generating a low beam light distribution;
- a second light source for generating a second light bundle and an optics unit disposed between the lens and the second light source for generating a supplementary light distribution, such that by superimposing the supplementary light distribution and the low beam light distribution, a high beam light distribution is formed.

BACKGROUND OF THE INVENTION

A headlamp for vehicles is known from WO 2012/034936 A1, having a projection module for generating a low beam and high beam light distribution. A reflector is assigned to a first light source, which focuses the light toward an edge of an aperture. The aperture, or aperture edge, respectively, is disposed in a focal plane of a lens, such that the aperture edge is imaged to form a light/dark border. In addition, a second light source is provided, as well as a further reflector, serving as an optics unit, which emits a second light bundle toward the lens. The aperture is formed by a flat aperture surface, which is applied to a transparent supporting body. Because the supporting body is transparent, the second light bundle can be conducted toward the lens, such that by superimposing the supplementary light distribution formed in this manner with the low beam light distribution formed by the first light bundle, a high beam light distribution can be obtained. The disadvantage with the known head lamp is that the complexity of the light guidance is relatively high. In particular, the known assembly requires a relatively great deal of space.

SUMMARY OF THE INVENTION

The object of the present invention is therefore to further develop a headlamp for vehicles functioning according to the projection principle, such that by using semiconductor light sources, a space saving light guidance for generating a low beam and high beam light distribution is obtained.

In order to achieve this object, the invention is characterized in that

- the optics unit is formed by a flat waveguide, having a light entry surface for receiving the second light bundle emitted from the second light source, wherein the second light source is disposed in the proximity of the light entry surface, having a light exit surface, and having flat sides extending between the light entry surface and the light exit surface, on which entering light can be conducted through total reflection,
- a light/dark border of the low beam light distribution is formed by the edge of the flat waveguide designed as the outer edge, which connects the light exit surface and an upper flat side of the waveguide,
- the upper flat side of the flat waveguide is provided with a light blocking coating, such that an entry of light beams of the first light bundle striking the upper flat side is prevented.

The particular advantage of the invention is that a relatively smaller projection module can be formed. A second light source that serves to generate a supplementary light distribution is merely disposed upstream of a flat waveguide. A front outer edge of this waveguide forms a boundary edge for light bundle emitted by a first light source, which is then imaged to form a low beam light distribution by means of the lens, wherein the front outer edge is imaged to form a light/dark border. The high beam light distribution is obtained by superimposing the low beam light distribution and the supplementary light distribution. Because the second light source is assigned to the flat wave guide as the sole optical source, the projection module can be produced in an inexpensive manner. An upper flat side of the waveguide has a light blocking coating, such that an undesired entry of diffused light into the waveguide by light beams of the first light bundle is prevented.

According to a preferred embodiment of the invention, the light blocking coating is disposed in a laminar manner on the upper flat side of the waveguide, wherein a border of the light blocking coating is disposed at a given distance to the front outer edge. Advantageously, a distortion of the light/dark border formed by the front outer edge is prevented in this manner.

According to a further development of the invention, the light blocking coating is applied to the upper flat side through sputtering. Advantageously, the light blocking coating can be applied in an inexpensive manner.

According to a further development of the invention, the waveguide is securely snapped into a frame-shaped mount. The mount is connected via fasteners to the reflector assigned to the first light source. The projection module thus has a compact structure.

According to a further development of the invention, the second light source is in the immediate proximity of the entry surface of the waveguide. The structural space requirements for the projection module can be substantially reduced as a result.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
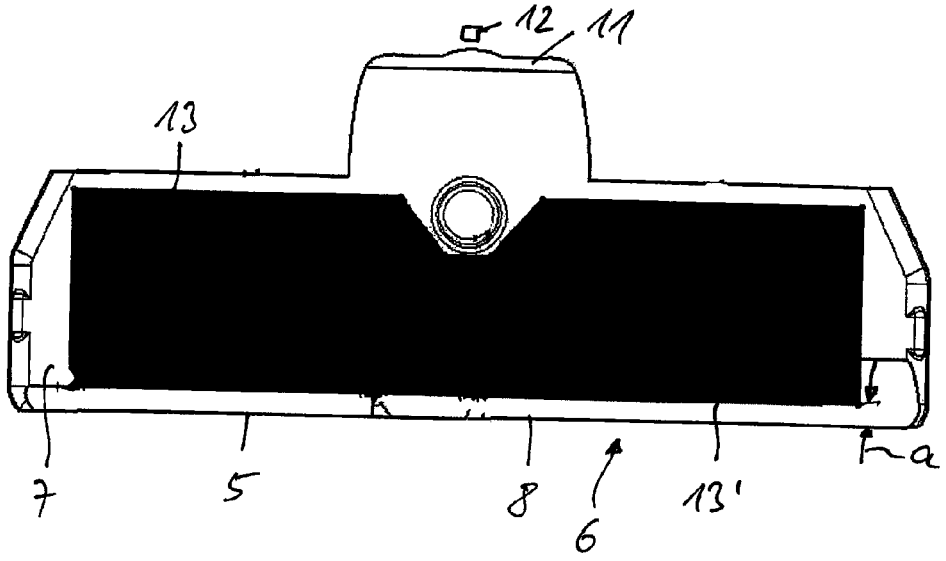
FIG. 1 shows a top view of a waveguide of a projection module, provided with a light blocking coating on the upper surface.
Figure 2:
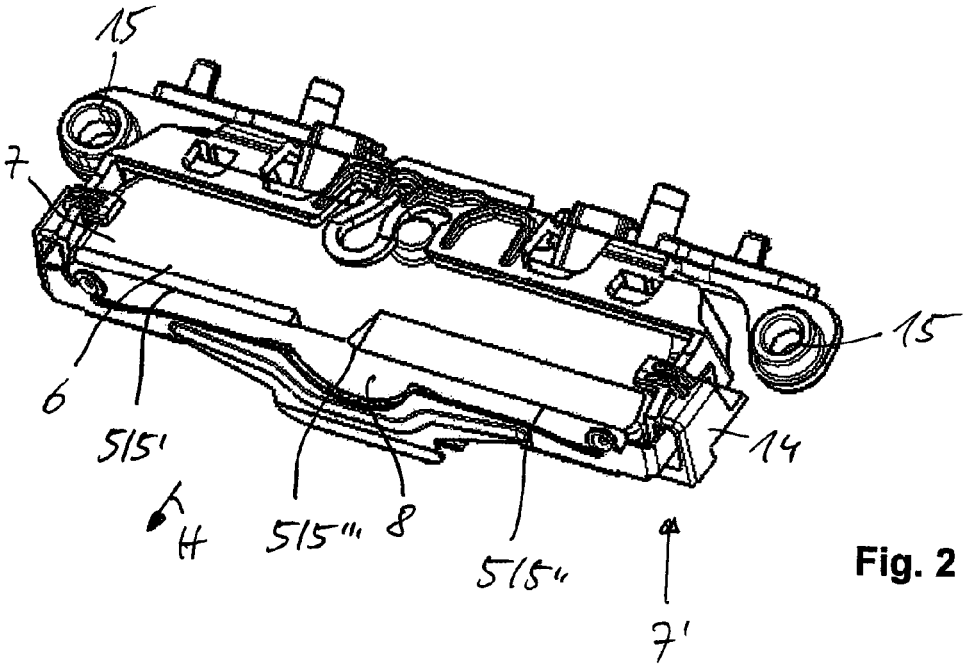
FIG. 2 shows a perspective depiction of the waveguide secured in a mount, without depicting the light blocking coating.

A headlamp for vehicles, in particular motor vehicles, is designed as a projection module 1, which serves to generate a low beam and a high beam light distribution.

A first light source 2 is provided for generating a first light bundle. The first light source 2 is designed as a semiconductor light source, in particular an LED light source (LED chip). Preferably, numerous first light sources 2 are disposed on a collective printed circuit board 3.

A half-shell shaped reflector 4 is disposed above the printed circuit board 3, which deflects the first light bundle emitted from the first light source 2 in the main beam direction H. The first light source 2 is disposed in a focal point of the ellipsoid-shaped reflector 4, such that the first light bundle is deflected toward a front outer edge 15 of a flat waveguide 6.

The front outer edge 5 connects an upper flat side 7 of the waveguide 6 with a front light exit surface 8 thereof. The front outer edge 5 has numerous line segments 5', 5", 5''', which serve to form a light/dark border for an asymmetrical low beam light distribution. The line segments 5', 5", 5''' are each straight, wherein the line segment 5''' runs at a diagonal to the other horizontal line segments 5', 5", in order to form the 15° rise.

The front outer edge 5 of the waveguide 6 is located in a focal plane of a lens 9 disposed upstream in the main beam direction H, which is encompassed by a lens mount 10. The lens 9 forms the front outer edge 5, designed basically as an "aperture edge," for a light/dark border of a low beam light distribution produced by the first light bundle.

Figure 3:
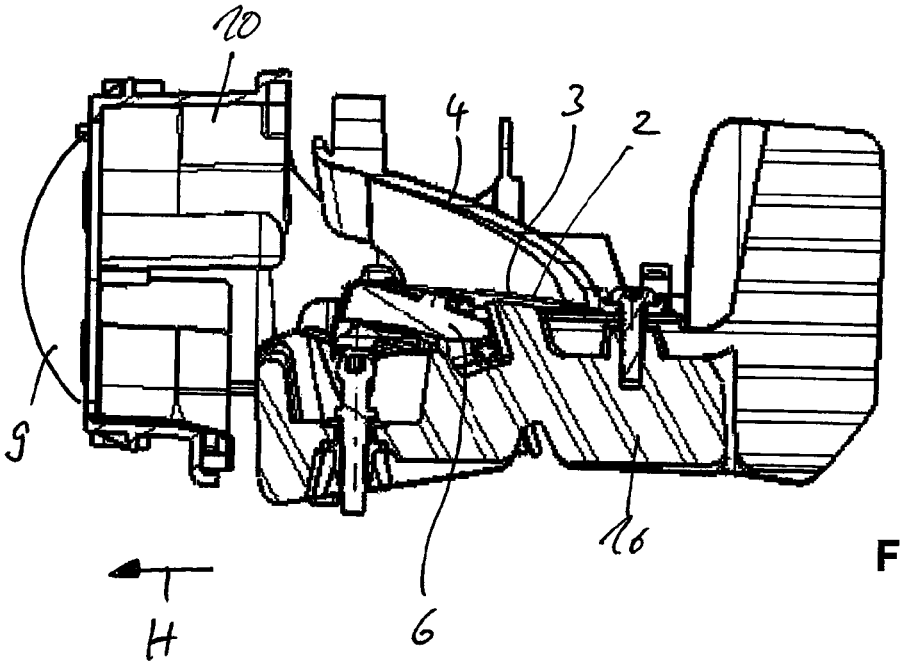
FIG. 3 shows a vertical cut through the projection module.

The waveguide 6 has a light entry surface 11 on a light entry side lying opposite the light exit surface 8, which is disposed in the immediate proximity of a second light source 12. A lower flat side 7' is provided lying opposite the upper flat side 7, which runs substantially parallel to the upper flat side 7. The waveguide 6 thus has a flat design, and extends substantially in a horizontal plane. It can be seen in FIG. 3 that the waveguide 6 is disposed at a slight angle to the horizontal plane.

The flat waveguide 6 interacts with the second light source 12 and the lens 9 such that a supplementary light distribution is generated, which forms a high beam light distribution when superimposed on the low beam light distribution produced by the first light source 2. By adding the second light source 12, it is thus possible to generate a high beam light distribution from the low beam light distribution.

In order to prevent an entry of undesired diffused light, produced by beams from the first light bundle deflected by the reflector 4, the upper flat side 7 of the waveguide 6 has a light blocking coating 13. This light blocking coating 13 extends over the upper flat surface 7 in a laminar manner, wherein a minimal distance to the front outer edge 5 is maintained. As can be seen in FIG. 1, a front edge 13' of the light blocking coating 13 is disposed at a distance a to the front outer edge 5. In this manner, a possible distortion of the light/dark border by the front outer edge 5 is prevented. The light blocking coating 13 runs substantially in a rectangular shape, and can be disposed such that it follows the contour of the upper flat side 7.

The light blocking coating 13 is applied to the transparent waveguide 6 through metallic sputtering.

The flat waveguide 6 is secured in a frame-shaped mount, which can be fastened to the reflector 4 by means of fasteners 15. The reflector 4 extends in the manner of a cover from a rear region above the waveguide 6 that contains the first light source 2, to a front edge of the semiconductor 6, in which the light exit surface 8 of the waveguide 6 is located.

The reflector 4 and the mount 14 are attached to a collective carrier 16, which is attached to a housing of the headlamp.

Both the first light source 2 as well as the second light source 12 are designed as LED light sources, which are preferably disposed on a printed circuit board in the form of a chip.

LIST OF REFERENCE SYMBOLS

1 projection module
2 light source
3 printed circuit board
4 reflector
5 front outer edge
5', 5", line segments
5'''
6 waveguide
7, 7' flat sides
8 light exit surface
9 lens
10 lens mount
11 light entry surface
12 $2^{nd}$ light source
13, 13' light blocking coating
14 mount
15 fasteners
16 carrier
H main beam direction
a distance

The invention claimed is:

1. A headlamp for vehicles comprising:

a projection module containing:

a first light source for generating a first light bundle, a reflector assigned to the first light source, a lens, an edge disposed in a focal plane for generating a low beam light distribution;

a second light source for generating a second light bundle and an optics unit disposed between the lens and the second light source for generating a supplementary light distribution, such that by superimposing the supplementary light distribution and the low beam light distribution, a high beam light distribution is formed, wherein the optics unit is formed by a flat waveguide having a light entry surface for receiving the second light bundle emitted from the second light source, wherein the second light source is disposed in the proximity of the light entry surface, having a light exit surface, and flat sides extending between the light entry surface and the light exit surface, on which entering light can be conducted through total reflection, wherein a light/dark border of the low beam light distribution is formed by the edge of the flat waveguide formed as the front outer edge, which connects the light exit surface and an upper flat side of the waveguide, and wherein the upper flat side of the flat waveguide is provided with a light blocking coating, such that an entry of light beams from the first light bundle striking the upper flat side is prevented.

2. The headlamp according to claim 1, wherein the light blocking coating extends over the surface of the upper flat side of the flat waveguide in a laminar manner, wherein an edge of the light blocking coating is disposed at a given distance (a) to the front outer edge of the upper flat side.

3. The headlamp according to claim 1 wherein the light blocking coating is applied to the upper flat side of the waveguide through sputtering.

4. The headlamp according to claim 1 wherein the light blocking coating is applied to the upper flat side of the flat waveguide through a metallic sputtering.

5. The headlamp according to claim 1 wherein at the flat waveguide is snapped securely in place in a frame-shaped mount.

6. The headlamp according to claim 5, wherein the mount has fasteners for connecting the same to the reflector.

7. The headlamp according to claim 1 wherein the front edge side has a number of line segments.

8. The headlamp according to claim 7, characterized in that wherein the line segments, are straight, wherein a line segment running at a diagonal to the adjacent line segments runs at a diagonal to form a 15° rise in an asymmetrical low beam light distribution.

9. The headlamp according to claim 1 wherein the first light source and the second light source are each designed as a semiconductor light source.

10. The headlamp according to claim 1 wherein the second light source is positioned in the immediate proximity of the light entry surface of the flat waveguide.

* * * * *